US009849563B2

(12) United States Patent
Thurber et al.

(10) Patent No.: US 9,849,563 B2
(45) Date of Patent: Dec. 26, 2017

(54) ABRASIVE ARTICLE AND METHOD OF MAKING THE SAME

(71) Applicant: 3M INNOVATIVE PROPERTIES COMPANY, St. Paul, MN (US)

(72) Inventors: Ernest L. Thurber, Sommerset, WI (US); Rebecca A. Putans, St. Paul, MN (US); Scott R. Culler, Burnsville, MN (US); John T. Boden, White Bear Lake, MN (US); Brian G. Koethe, Cottage Grove, MN (US); Brant A. Moegenburg, Baldwin, WI (US); Thomas J. Nelson, St. Paul, MN (US); Aaron K. Nienaber, Maplewood, MN (US); Wayne W. Maurer, Lakeville, MN (US); Ibrahim A. El-Hedok, Woodbury, MN (US); Albert I. Everaerts, Oakdale, MN (US); Joseph B. Eckel, Vadnais Heights, MN (US); Mahfuza B. Ali, Mendota Heights, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 134 days.

(21) Appl. No.: 14/933,479

(22) Filed: Nov. 5, 2015

(65) Prior Publication Data

US 2017/0129075 A1 May 11, 2017

(51) Int. Cl.
*B24D 3/28* (2006.01)
*B24D 11/00* (2006.01)
(Continued)

(52) U.S. Cl.
CPC ..... *B24D 11/005* (2013.01); *B24D 3/002* (2013.01); *B24D 3/28* (2013.01); *B24D 18/0072* (2013.01)

(58) Field of Classification Search
CPC ..... B24D 11/005; B24D 3/002; B24D 3/28; B24D 18/0072
See application file for complete search history.

(56) References Cited

U.S. PATENT DOCUMENTS 1,910,444 A 5/1933 Nicholson
2,553,816 A 5/1951 Ebel
(Continued)

FOREIGN PATENT DOCUMENTS

CN 1089291 7/1994
GB 1063324 3/1967
(Continued)

OTHER PUBLICATIONS

International Search Report, PCT/US2016/058647, dated Feb. 2, 2017, 3 pages.
(Continued)

*Primary Examiner* — Pegah Parvini
(74) *Attorney, Agent, or Firm* — Bradford B. Wright

(57) ABSTRACT

An abrasive article comprises abrasive particles adhered to a substrate by a binder material comprising an at least partially cured resole phenolic resin and an aliphatic tack modifier. The amount of resole phenolic resin comprises from 60 to 98 weight percent of the combined weight of the resole phenolic resin and the aliphatic tack modifier. A method of making the abrasive article is also disclosed.

16 Claims, 1 Drawing Sheet

(51) Int. Cl.
*B24D 18/00* (2006.01)
*B24D 3/00* (2006.01)

(56) References Cited

U.S. PATENT DOCUMENTS

| | | | | |
|---|---|---|---|---|
| 2,958,593 | A | 11/1960 | Hoover | |
| 3,041,156 | A | 6/1962 | Rowse | |
| 3,116,986 | A | 1/1964 | Goepfert | |
| 4,227,350 | A | 10/1980 | Fitzer | |
| 4,314,827 | A | 2/1982 | Leitheiser | |
| 4,418,120 | A | 11/1983 | Kealy | |
| 4,588,419 | A | 5/1986 | Caul | |
| 4,623,364 | A | 11/1986 | Cottringer | |
| 4,652,275 | A | 3/1987 | Bloecher | |
| 4,734,104 | A | 3/1988 | Broberg | |
| 4,737,163 | A | 4/1988 | Larkey | |
| 4,744,802 | A | 5/1988 | Schwabel | |
| 4,751,138 | A | 6/1988 | Tumey | |
| 4,770,671 | A | 9/1988 | Monroe | |
| 4,781,957 | A | 11/1988 | Brown | |
| 4,799,939 | A | 1/1989 | Bloecher | |
| 4,881,951 | A | 11/1989 | Wood | |
| 4,898,762 | A | 2/1990 | Brown | |
| 4,991,362 | A | 2/1991 | Heyer | |
| 4,997,461 | A | 3/1991 | Markhoff-Matheny | |
| 5,009,675 | A | 4/1991 | Kunz | |
| 5,011,508 | A | 4/1991 | Wald | |
| 5,042,991 | A | 8/1991 | Kunz | |
| 5,085,671 | A | 2/1992 | Martin | |
| 5,152,917 | A | 10/1992 | Pieper | |
| 5,201,916 | A | 4/1993 | Berg | |
| 5,203,884 | A | 4/1993 | Buchanan | |
| 5,213,591 | A | 5/1993 | Celikkaya | |
| 5,256,170 | A | 10/1993 | Harmer | |
| 5,344,688 | A | 9/1994 | Peterson et al. | |
| 5,352,254 | A | 10/1994 | Celikkaya | |
| 5,366,523 | A | 11/1994 | Rowenhorst | |
| 5,378,251 | A | 1/1995 | Culler | |
| 5,435,816 | A | 7/1995 | Spurgeon | |
| 5,436,063 | A | 7/1995 | Follett | |
| 5,441,549 | A | 8/1995 | Helmin | |
| 5,496,386 | A | 3/1996 | Broberg | |
| 5,500,273 | A * | 3/1996 | Holmes | B24D 3/28 428/147 |
| 5,520,711 | A | 5/1996 | Helmin | |
| 5,551,961 | A | 9/1996 | Engen | |
| 5,582,672 | A | 12/1996 | Follett | |
| 5,591,239 | A | 1/1997 | Larson | |
| 5,609,706 | A | 3/1997 | Benedict | |
| RE35,570 | E | 7/1997 | Rowenhorst | |
| 5,672,097 | A | 9/1997 | Hoopman | |
| 5,681,361 | A | 10/1997 | Sanders, Jr. | |
| 5,712,210 | A | 1/1998 | Windisch | |
| 5,858,140 | A | 1/1999 | Berger | |
| 5,914,157 | A | 6/1999 | Munson | |
| 5,928,070 | A | 7/1999 | Lux | |
| 5,946,991 | A | 9/1999 | Hoopman | |
| 5,961,674 | A | 10/1999 | Gagliardi | |
| 5,975,987 | A | 11/1999 | Hoopman | |
| 5,975,988 | A | 11/1999 | Christianson | |
| 5,984,988 | A | 11/1999 | Berg | |
| 6,017,831 | A | 1/2000 | Beardsley | |
| 6,129,540 | A | 10/2000 | Hoopman | |
| 6,521,005 | B1 | 2/2003 | Vincent | |
| 6,565,969 | B1 | 5/2003 | Lamon | |
| 6,843,815 | B1 | 1/2005 | Thurber | |
| 6,979,713 | B2 | 12/2005 | Barber, Jr. | |
| 7,169,199 | B2 | 1/2007 | Barber, Jr. | |
| 8,034,137 | B2 | 10/2011 | Erickson | |
| 8,142,531 | B2 | 3/2012 | Adefris | |
| 8,142,532 | B2 | 3/2012 | Erickson | |
| 8,142,891 | B2 | 3/2012 | Culler | |
| 2007/0037500 | A1 | 2/2007 | Minick et al. | |
| 2007/0231571 | A1 | 10/2007 | Lane | |
| 2009/0165394 | A1 | 7/2009 | Culler | |
| 2009/0169816 | A1 | 7/2009 | Erickson | |
| 2009/0325466 | A1 * | 12/2009 | Kincaid | B24D 3/20 451/28 |
| 2011/0244769 | A1 | 10/2011 | David et al. | |
| 2012/0227333 | A1 | 9/2012 | Adefris | |
| 2013/0040537 | A1 | 2/2013 | Schwabel | |
| 2013/0125477 | A1 | 5/2013 | Adefris | |
| 2013/0337725 | A1 | 12/2013 | Monroe | |
| 2014/0150766 | A1 | 6/2014 | Che et al. | |
| 2014/0170362 | A1 | 6/2014 | Ali | |
| 2015/0037559 | A1 | 2/2015 | Dollase | |

FOREIGN PATENT DOCUMENTS

| | | |
|---|---|---|
| WO | WO 97/07963 | 3/1997 |
| WO | WO 2014/209622 | 12/2014 |
| WO | WO 2015/100018 | 7/2015 |

OTHER PUBLICATIONS

Arizona Chemical, "Safety Data Sheet", Jan. 19, 2015, pp. 7 pages.
Arizona Chemical, "Tackifier Dispersions", 4 pages.
Othmer, "Phenolic Resin", Encyclopedia of Chemical Technology, 1996, vol. 18, No. 4, pp. 603-644.
Phenolic Resin for the Rubber Industry—An Overview, Ram Charan Product Development Information, Nov. 2012, vol. 2, No. 8, pp. 1-6.

* cited by examiner

ABRASIVE ARTICLE AND METHOD OF MAKING THE SAME

TECHNICAL FIELD

The present disclosure relates to abrasive articles including a phenolic binder material and abrasive particles, and methods of making the same.

BACKGROUND

Abrasive articles generally comprise abrasive particles (also known as "grains") retained within a binder. During manufacture of various types of abrasive articles, the abrasive particles are deposited on a binder material precursor in an oriented manner (e.g., by electrostatic coating or by some mechanical placement technique). Typically, the most desirable orientation of the abrasive particles is substantially perpendicular to the surface of the backing.

In the case of nonwoven abrasive articles, the binder material precursor is coated on a lofty open nonwoven fiber web, the abrasive particles are adhered to the binder material precursor, and then the binder material precursor is cured sufficiently to retain the abrasive particles during use.

In the case of certain coated abrasive articles (e.g., sandpaper), the backing is a relatively dense planar substrate (e.g., vulcanized fiber or a woven or knit fabric, optionally treated to a saturant to increase durability). A make layer precursor (or make coat) containing a first binder material precursor is applied to the backing, and then the abrasive particles are partially embedded into the make layer precursor. Frequently, the abrasive particles are embedded in the make layer precursor with a degree of orientation; e.g., by electrostatic coating or by a mechanical placement technique. The make layer precursor is then at least partially cured in order to retain the abrasive particles when a size layer precursor (or size coat) containing a second binder material precursor is overlaid on the at least partially cured make layer precursor and abrasive particles. Next, the size layer precursor, and the make layer precursor if not sufficiently cured, at cured to form the coated abrasive article.

For both of the above types of abrasive articles it is generally desirable that the abrasive particles remain in their original orientation as embedded in the binder material precursor until it have been sufficiently cured to fix them in place. This is especially troublesome when the binder precursor material is too fluid so that the particles tip over by gravity, or if the binder precursor material is too hard such that the particle do not adhere to the binder precursor material and again tip over due to gravity.

Abrasive particle tipping after deposition is especially problematic with resole phenolic resin binder material precursors. It would be desirable to have resole-phenolic-resin-based binder material precursors that the original orientation of the applied abrasive particles until curing.

SUMMARY

The present disclosure overcomes this problem, by using a resole-based curable composition that further includes an aliphatic tack modifier during manufacture of the abrasive article.

Accordingly, in one aspect, the present disclosure provides a method of making an abrasive article comprising:

disposing a curable tacky adhesive composition on a substrate, wherein the tacky curable adhesive composition comprises a resole phenolic resin and an aliphatic tack modifier, and wherein the amount of resole phenolic resin comprises from 60 to 98 weight percent of the combined weight of the resole phenolic resin and the aliphatic tack modifier;

adhering abrasive particles to the curable tacky adhesive composition; and at least partially curing the curable tacky adhesive composition.

In another aspect, the present disclosure provides an abrasive article comprising abrasive particles adhered to a substrate by a binder material comprising an at least partially cured resole phenolic resin and an aliphatic tack modifier, wherein the amount of resole phenolic resin comprises from 60 to 98 weight percent of the combined weight of the resole phenolic resin and the aliphatic tack modifier.

While phenolic resins are known as tackifiers when used in minor amounts for rubber-based adhesives, we have unexpectedly found that addition of aliphatic tack modifiers as disclosed herein can achieve a level of tack sufficient to hold abrasive particles substantially in their "as applied" orientation until the binder precursor material is cured. The formulations used herein lie well outside the normal formulation parameters for typical alternatives such as pressure-sensitive adhesives.

As used herein, the term "aliphatic" means an organic compound that is free of aromatic (e.g., phenyl or phenylene) functional groups. Aliphatic compounds may be linear, branched, or alicyclic (i.e., containing one or more rings).

Features and advantages of the present disclosure will be further understood upon consideration of the detailed description as well as the appended claims.

Figure 1:
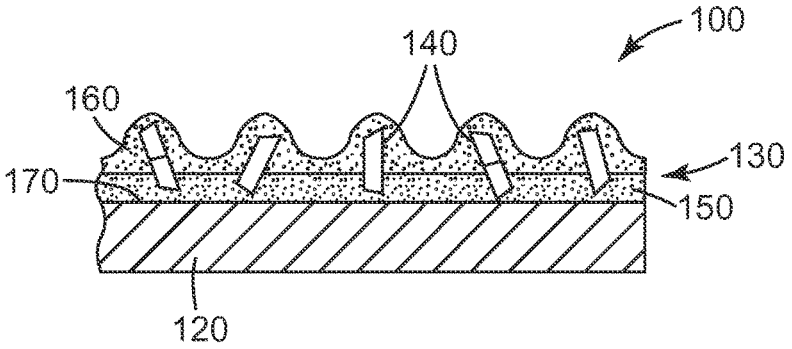
FIG. 1 is a cross-sectional side view of an exemplary coated abrasive article 100 according to the present disclosure.

Repeated use of reference characters in the specification and drawings is intended to represent the same or analogous features or elements of the disclosure. It should be understood that numerous other modifications and embodiments can be devised by those skilled in the art, which fall within the scope and spirit of the principles of the disclosure. The figures may not be drawn to scale.

DETAILED DESCRIPTION

An exemplary embodiment of a coated abrasive article according to the present disclosure is depicted in FIG. 1. Referring now to FIG. 1, coated abrasive article 100 has a backing 120 and abrasive layer 130. Abrasive layer 130 includes abrasive particles 140 secured to a major surface 170 of backing 120 (substrate) by make layer 150 and size layer 160. Additional layers, for example, such as an optional supersize layer (not shown) that is superimposed on the size layer, or a backing antistatic treatment layer (not shown) may also be included, if desired.

Coated abrasive articles according to the present disclosure may include additional layers such as, for example, an optional supersize layer that is superimposed on the abrasive layer, or a backing antistatic treatment layer may also be included, if desired. Useful backings include, for example, those known in the art for making coated abrasive articles. Typically, the backing has two opposed major surfaces. The thickness of the backing generally ranges from about 0.02 to about 5 millimeters, desirably from about 0.05 to about 2.5 millimeters, and more desirably from about 0.1 to about 0.4 millimeter, although thicknesses outside of these ranges may also be useful. Exemplary backings include: dense nonwoven fabrics (for example, including needletacked, meltspun, spunbonded, hydroentangled, or meltblown nonwoven fabrics), knitted, stitchbonded, and/or woven fabrics; scrims; polymer films; treated versions thereof and combinations of two or more of these materials.

Fabric backings can be made from any known fibers, whether natural, synthetic or a blend of natural and synthetic fibers. Examples of useful fiber materials include fibers or yarns comprising polyester (for example, polyethylene terephthalate), polyamide (for example, hexamethylene adipamide, polycaprolactam), polypropylene, acrylic (formed from a polymer of acrylonitrile), cellulose acetate, polyvinylidene chloride-vinyl chloride copolymers, vinyl chloride-acrylonitrile copolymers, graphite, polyimide, silk, cotton, linen, jute, hemp, or rayon. Useful fibers may be of virgin materials or of recycled or waste materials reclaimed from garment cuttings, carpet manufacturing, fiber manufacturing, or textile processing, for example. Useful fibers may be homogenous or a composite such as a bicomponent fiber (for example, a co-spun sheath-core fiber). The fibers may be tensilized and crimped, but may also be continuous filaments such as those formed by an extrusion process.

The thickness of the backing generally ranges from about 0.02 to about 5 millimeters, desirably from about 0.05 to about 2.5 millimeters, and more desirably from about 0.1 to about 0.4 millimeter, although thicknesses outside of these ranges may also be useful, for example, depending on the intended use. Generally, the strength of the backing should be sufficient to resist tearing or other damage during abrading processes. The thickness and smoothness of the backing should also be suitable to provide the desired thickness and smoothness of the coated abrasive article; for example, depending on the intended application or use of the coated abrasive article.

The fabric backing may have any basis weight; typically, in a range of from 100 to 1000 grams per square meter (gsm), more typically 450 to 600 gsm, and even more typically 450 to 575 gsm. The fabric backing typically has good flexibility; however, this is not a requirement. To promote adhesion of binder resins to the fabric backing, one or more surfaces of the backing may be modified by known methods including corona discharge, ultraviolet light exposure, electron beam exposure, flame discharge, and/or scuffing.

The make layer is formed by at least partially curing a make layer precursor that is a curable tacky adhesive composition according to the present disclosure. The tacky curable adhesive composition comprises a resole phenolic resin and an aliphatic tack modifier, and wherein the amount of resole phenolic resin comprises from 60 to 98 weight percent of the combined weight of the resole phenolic resin and the aliphatic tack modifier.

Phenolic resins are generally formed by condensation of phenol and formaldehyde, and are usually categorized as resole or novolac phenolic resins. Novolac phenolic resins are acid-catalyzed and have a molar ratio of formaldehyde to phenol of less than 1:1. Resole (also resol) phenolic resins can be catalyzed by alkaline catalysts, and the molar ratio of formaldehyde to phenol is greater than or equal to one, typically between 1.0 and 3.0, thus presenting pendant methylol groups. Alkaline catalysts suitable for catalyzing the reaction between aldehyde and phenolic components of resole phenolic resins include sodium hydroxide, barium hydroxide, potassium hydroxide, calcium hydroxide, organic amines, and sodium carbonate, all as solutions of the catalyst dissolved in water.

Resole phenolic resins are typically coated as a solution with water and/or organic solvent (e.g., alcohol). Typically, the solution includes about 70 percent to about 85 percent solids by weight, although other concentrations may be used. If the solids content is very low, then more energy is required to remove the water and/or solvent. If the solids content is very high, then the viscosity of the resulting phenolic resin is too high which typically leads to processing problems.

Phenolic resins are well-known and readily available from commercial sources. Examples of commercially available resole phenolic resins useful in practice of the present disclosure include those marketed by Durez Corporation under the trade designation VARCUM (e.g., 29217, 29306, 29318, 29338, 29353); those marketed by Ashland Chemical Co. of Bartow, Fla. under the trade designation AEROFENE (e.g., AEROFENE 295); and those marketed by Kangnam Chemical Company Ltd. of Seoul, South Korea under the trade designation PHENOLITE (e.g., PHENOLITE TD-2207).

A general discussion of phenolic resins and their manufacture is given in Kirk-Othmer, *Encyclopedia of Chemical Technology,* 4th Ed., John Wiley & Sons, 1996, New York, Vol. 18, pp. 603-644.

In addition to the resole phenolic resin, the curable tacky binder precursor contains an aliphatic tack modifier. The curable tacky binder precursor contains from 60 to 98 weight percent, preferably 90 to 98 weight, percent of the resole phenolic resin based on the combined weight of the resole phenolic resin and the aliphatic tack modifier. Accordingly, the curable tacky binder precursor composition contains from 2 to 40 weight percent, preferably 2 to 10 weight percent, of the aliphatic tack modifier, based on the combined weight of the resole phenolic resin and the aliphatic tack modifier.

The aliphatic tack modifier has the unexpected effect of modifying the tackiness of the resole phenolic resin thereby resulting in the curable tacky binder precursor composition.

Without wishing to be bound by theory, the present inventors believe that nonpolar non-rubbery hydrocarbon aliphatic tack modifiers preferentially migrate to the surface of the make layer precursor during manufacturing prior to adhering the abrasive particles. These compounds provide the increased tackiness desired for adhering the abrasive particles and holding them in position until the make layer precursor is sufficiently cured to fix the abrasive particles in position. Likewise, rubbery polymeric tack aliphatic modifiers are believed not only increase the tack, but also increase cohesive strength of the make layer precursor. This has the added advantage of reducing binder precursor transfer to a placement tool used during placement of the abrasive particles onto the make layer precursor.

Examples of suitable aliphatic tack modifiers include: aliphatic rosins and aliphatic derivatives thereof; aliphatic liquid hydrocarbon resins; aliphatic solid hydrocarbon resins; liquid natural rubber; hydrogenated polybutadiene; polytetramethylene ether glycol; isooctyl acrylate-acrylic acid copolymers as described in U.S. Pat. No. 4,418,120 (Kealy et. al; and acrylic zwitterionic amphiphilic polymers as described in U.S. Pat. Appln. Publ. 2014/0170362 A1 (Ali et al.).

Combinations of more than one resole phenolic resin and/or more than one aliphatic tack modifier may be used if desired.

Useful aliphatic rosins and aliphatic derivatives thereof include, for example, aliphatic esters of natural and modified rosins and the hydrogenated derivatives thereof (e.g., a glycerol ester of tall oil rosin marketed as PERMALYN 2085 and a glycerol ester of hydrogenated gum rosin marketed as FORAL 5-E, both available from Eastman Chemical Company, and an aliphatic rosin ester dispersion obtained as AQUATAC 6085 from Arizona Chemical, Jacksonville, Fla.), hydrogenated rosin resins (e.g., partially hydrogenated rosin is produced by Eastman Chemical Company as STAYBELITE-E and completely hydrogenated rosin is branded as FORAL AX-E), dimerized rosin resins (e.g., POLY-PALE partially dimerized rosin is a partially dimerized rosin product offered by Eastman Chemical Company), and aliphatic modified rosin resins (e.g., maleic anhydride modified rosin resins marketed as LEWISOL 28-M or LEWISOL 29-M).

Examples of aliphatic hydrocarbon resin tackifiers include tackifiers derived from liquid C5 feedstock by Lewis acid catalyzed polymerization, and hydrogenated derivatives thereof. Commercially available aliphatic hydrocarbon resin tackifiers include those marketed by Eastman Chemical Company, Kingsport, Tenn., under the trade designations PICCOTAC 1020, PICCOTAC 1095, PICCOTAC 1098, PICCOTAC 1100, and PICCOTAC 1115, and in hydrogenated forms as EASTOTAC H-100E, EASTOTAC H-115E and EASTOCTAC H-130E.

Liquid natural rubber is a modified form of natural rubber with a shorter polymeric chain. Many liquid natural rubbers are commercially available. Examples include liquid natural rubbers marketed by DPR industries, Coatesville, Pa., under the trade designations DPR 35, DPR 40, DPR 75, and DPR 400.

Hydrogenated polybutadienes are available commercially; for example, as KRATON LIQUID L1203 from Kraton Polymers US LLC, Houston, Tex., and as POLY-TAIL from Mitsubishi International Polymer/Trade Corporation, Newark, N.J.

Polytetramethylene ether glycol (PTMEG) is a waxy, white solid that melts to a clear, colorless viscous liquid near room temperature. PTMEG is produced by the catalyzed polymerization of tetrahydrofuran. Exemplary polytetramethylene ether glycols include those available under the trade designation TETRATHANE from Invista, Waynesboro, Va. (e.g., TETRATHANE 250, 650, 1000, 1400, 1800, 2000 and 2900).

Useful copolymers of isooctyl acrylate and acrylic acid are described in U.S. Pat. No. 4,418,120 (Kealy et. al). Examples include copolymers of isooctyl acrylate (IOA) and acrylic acid (AA) wherein the weight ratio of IOA:AA is in the range of from 93:7 to 97:3; more preferably abut 95:5.

Useful aliphatic zwitterionic amphiphilic acrylic polymers are described in U.S. Pat. Appln. Publ. 2014/0170362 A1 (Ali et al.). Examples of useful zwitterionic amphiphilic acrylic polymers include the polymerized product of an anionic monomer that is acrylic acid, methacrylic acid, a salt thereof, or a blend thereof; an acrylate or methacrylate ester of an alcohol having between 8 and 12 carbons; and a cationic monomer that is an acrylate or methacrylate ester having alkylammonium functionality. Optionally, one or more additional monomers are included in the zwitterionic polymers of the invention. In some embodiments the anionic monomer is acrylic or methacrylic acid, the acid is converted either before or after polymerization to a corresponding carboxylate salt by neutralization. In some embodiments, the acrylic acid, methacrylic acid, or a salt thereof is a mixture of two or more thereof. In some embodiments, the acrylate or methacrylate ester is a mixture of two or more such esters; in some embodiments, the cationic monomer is a mixture of two or more such cationic monomers.

In some embodiments, the polymerized product of acrylic acid, methacrylic acid, a salt thereof or blend thereof is present in the zwitterionic polymer at about 0.2 wt. % to 5 wt. % based on the total weight of the polymer, or at about 0.5 wt. % to 5 wt. % of the zwitterionic polymer, or in various intermediate levels such as 0.3 wt. %, 0.4 wt. %, 0.6 wt. %, 0.7 wt. %, and all other such individual values represented by 0.1 wt. % increments between 0.2 and 5.0 wt. %, and in ranges spanning between any of these individual values in 0.1 wt. % increments, such as 0.2 wt. % to 0.9 wt. %, 1.2 wt. % to 3.1 wt. %, and the like.

In some embodiments, the acrylate or methacrylate ester of an alcohol having between 8 and 12 carbons includes acrylate or methacrylate esters of linear, branched, or cyclic alcohols. While not intended to be limiting, examples of alcohols useful in the acrylate or methacrylate esters include octyl, isooctyl, nonyl, isononyl, decyl, undecyl, and dodecyl alcohol. In embodiments, the alcohol is isooctyl alcohol. In some embodiments, the acrylate or methacrylate ester of an alcohol having between 8 and 12 carbons is a mixture of two or more such compounds. In embodiments, polymerized product of the acrylate or methacrylate ester of an alcohol having between 8 and 12 carbons is present in the zwitterionic polymer at about 50 wt. % to 95 wt. % of the total weight of the polymer, or at about 60 wt. % to 90 wt. % of the total weight of the polymer, or at about 75 wt. % to 85 wt. % of the total weight of the polymer, or in various intermediate levels such as 51 wt. %, 52 wt. %, 53 wt. %, 54 wt. %, and all other such values individually represented by 1 wt. % increments between 50 wt. % and 95 wt. %, and in any range spanning between any of these individual values in 1 wt. % increments, for example ranges such as about 54 wt. % to 81 wt. %, about 66 wt. % to 82 wt. %, about 77 wt. % to 79 wt. %, and the like.

In some embodiments, the cationic monomer is an acrylate or methacrylate ester including an alkylammonium functionality. In some embodiments, the cationic monomer is a 2-(trialkylammonium)ethyl acrylate or a 2-(trialkylammonium)ethyl methacrylate. In such embodiments, the nature of the alkyl groups is not particularly limited; however, cost and practicality limit the number of useful embodiments. In embodiments, the 2-(trialkylammonium) ethyl acrylate or 2-(trialkylammonium)ethyl methacrylate is formed by the reaction of 2-(dimethylamino)ethyl acrylate or 2-(dimethylamino)ethyl methacrylate with an alkyl halide; in such embodiments, at least two of the three alkyl groups of the 2-(trialkylammonium)ethyl acrylate or 2-(trialkylammonium)ethyl methacrylate are methyl. In some such embodiments, all three alkyl groups are methyl groups. In other embodiments, two of the three alkyl groups are methyl and the third is a linear, branched, cyclic, or alicyclic group having between 2 and 24 carbon atoms, or between 6 and 20 carbon atoms, or between 8 and 18 carbon atoms, or 16 carbon atoms. In some embodiments, the cationic monomer is a mixture of two or more of these compounds.

The anion associated with the ammonium functionality of the cationic monomer is not particularly limited, and many anions are useful in connection with various embodiments of the invention. In some embodiments, the anion is a halide anion, such as chloride, bromide, fluoride, or iodide; in some such embodiments, the anion is chloride. In other embodiments the anion is $BF_4^-$, $^-N(SO_2CF_3)_2$, $^-O_3SCF_3$, or $^-O_3SC_4F_9$. In other embodiments, the anion is methyl sulfate. In still other embodiments, the anion is hydroxide. In some embodiments, the one or more cationic monomers includes a mixture of two or more of these anions. In some embodiments, polymerization is carried out using 2-(dimethylamino)ethyl acrylate or 2-(dimethylamino)ethyl methacrylate, and the corresponding ammonium functionality is formed in situ by reacting the amino groups present within the polymer with a suitable alkyl halide to form the corresponding ammonium halide functionality. In other embodiments, the ammonium functional monomer is incorporated into the cationic polymer and then the anion is exchanged to provide a different anion. In such embodiments, ion exchange is carried out using any of the conventional processes known to and commonly employed by those having skill in the art.

In some embodiments, the polymerized product of the cationic monomer is present in the zwitterionic polymer at about 2 wt. % to 45 wt. % based on the total weight of the zwitterionic polymer, or at about 2 wt. % to 35 wt. % of the zwitterionic polymer, or at about 4 wt. % to 25 wt. % of the zwitterionic polymer, or at about 6 wt. % to 15 wt. % of the zwitterionic polymer, or at about 7 wt. % to 10 wt. % of the zwitterionic polymer, or in various intermediate levels such as 3 wt. %, 5 wt. %, 6 wt. %, 8 wt. %, and all other such individual values represented by 1 wt. % increments between 2 wt. % and 45 wt. %, and in any range spanning these individual values in 1 wt. % increments, such as 2 wt. % to 4 wt. %, 7 wt. % to 38 wt. %, 20 wt. % to 25 wt. %, and the like.

The curable tacky binder precursor material may also contain additives such as fibers, lubricants, wetting agents, thixotropic materials, surfactants, pigments, dyes, antistatic agents (e.g., carbon black, vanadium oxide, graphite, etc.), coupling agents (e.g., silanes, titanates, zircoaluminates, etc.), plasticizers, suspending agents, and the like. The amounts of these optional additives are selected to provide the preferred properties. The coupling agents can improve adhesion to the abrasive particles and/or filler. The binder chemistry may be thermally cured, radiation cured or combinations thereof. Additional details on binder chemistry may be found in U.S. Pat. No. 4,588,419 (Caul et al.), U.S. Pat. No. 4,751,138 (Tumey et al.), and U.S. Pat. No. 5,436,063 (Follett et al.).

The curable tacky binder precursor material may also contain filler materials or grinding aids, typically in the form of a particulate material. Typically, the particulate materials are inorganic materials. Examples of useful fillers for this disclosure include: metal carbonates (e.g., calcium carbonate (e.g., chalk, calcite, marl, travertine, marble and limestone), calcium magnesium carbonate, sodium carbonate, magnesium carbonate), silica (e.g., quartz, glass beads, glass bubbles and glass fibers) silicates (e.g., talc, clays, (montmorillonite) feldspar, mica, calcium silicate, calcium metasilicate, sodium aluminosilicate, sodium silicate) metal sulfates (e.g., calcium sulfate, barium sulfate, sodium sulfate, aluminum sodium sulfate, aluminum sulfate), gypsum, vermiculite, wood flour, aluminum trihydrate, carbon black, metal oxides (e.g., calcium oxide (lime), aluminum oxide, titanium dioxide), and metal sulfites (e.g., calcium sulfite).

The size layer precursor may be the same as or different than the make layer precursor. Examples of suitable thermosetting resins that may be useful for the size layer precursor include, for example, free-radically polymerizable monomers and/or oligomers, epoxy resins, acrylic resins, urethane resins, phenolic resins, urea-formaldehyde resins, melamine-formaldehyde resins, aminoplast resins, cyanate resins, or combinations thereof. Useful binder precursors include thermally curable resins and radiation curable resins, which may be cured, for example, thermally and/or by exposure to radiation.

The size layer precursor may also be modified various additives (e.g., as discussed above in regard to the make coat precursor). Catalysts and/or initiators may be added to thermosetting resins; for example, according to conventional practice and depending on the resin used.

Heat energy is commonly applied to advance curing of the thermosetting resins (e.g., size layer precursor or curable tacky binder material precursor compositions according to the present disclosure); however, other sources of energy (e.g., microwave radiation, infrared light, ultraviolet light, visible light, may also be used). The selection will generally be dictated by the particular resin system selected.

Useful abrasive particles may be the result of a crushing operation (e.g., crushed abrasive particles that have been sorted for shape and size) or the result of a shaping operation (i.e., shaped abrasive particles) in which an abrasive precursor material is shaped (e.g., molded), dried, and converted to ceramic material. Combinations of abrasive particles resulting from crushing with abrasive particles resulting from a shaping operation may also be used. The abrasive particles may be in the form of, for example, individual particles, agglomerates, composite particles, and mixtures thereof.

The abrasive particles should have sufficient hardness and surface roughness to function as crushed abrasive particles in abrading processes. Preferably, the abrasive particles have a Mohs hardness of at least 4, at least 5, at least 6, at least 7, or even at least 8.

Suitable abrasive particles include, for example, crushed abrasive particles comprising fused aluminum oxide, heat-treated aluminum oxide, white fused aluminum oxide, ceramic aluminum oxide materials such as those commercially available as 3M CERAMIC ABRASIVE GRAIN from 3M Company, St. Paul, Minn., brown aluminum oxide, blue aluminum oxide, silicon carbide (including green silicon carbide), titanium diboride, boron carbide, tungsten carbide, garnet, titanium carbide, diamond, cubic boron nitride, garnet, fused alumina zirconia, iron oxide, chromia, zirconia, titania, tin oxide, quartz, feldspar, flint, emery, sol-gel-derived ceramic (e.g., alpha alumina), and combinations thereof. Examples of sol-gel-derived abrasive particles from which the abrasive particles can be isolated, and methods for their preparation can be found, in U.S. Pat. No. 4,314,827 (Leitheiser et al.); U.S. Pat. No. 4,623,364 (Cottringer et al.); U.S. Pat. No. 4,744,802 (Schwabel), U.S. Pat. No. 4,770,671 (Monroe et al.); and U.S. Pat. No. 4,881,951 (Monroe et al.). It is also contemplated that the abrasive particles could comprise abrasive agglomerates such, for example, as those described in U.S. Pat. No. 4,652,275 (Bloecher et al.) or U.S. Pat. No. 4,799,939 (Bloecher et al.). In some embodiments, the abrasive particles may be surface-treated with a coupling agent (e.g., an organosilane coupling agent) or other physical treatment (e.g., iron oxide or titanium oxide) to enhance adhesion of the crushed abrasive particles to the binder. The abrasive particles may be treated before combining them with the binder, or they may be surface treated in situ by including a coupling agent to the binder.

Preferably, the abrasive particles (and especially the abrasive particles) comprise ceramic abrasive particles such as, for example, sol-gel-derived polycrystalline alpha alumina particles. Ceramic abrasive particles composed of crystallites of alpha alumina, magnesium alumina spinel, and a rare earth hexagonal aluminate may be prepared using sol-gel precursor alpha alumina particles according to methods described in, for example, U.S. Pat. No. 5,213,591 (Celikkaya et al.) and U.S. Publ. Pat. Appln. Nos. 2009/0165394 A1 (Culler et al.) and 2009/0169816 A1 (Erickson et al.). Further details concerning methods of making sol-gel-derived abrasive particles can be found in, for example, U.S. Pat. No. 4,314,827 (Leitheiser); U.S. Pat. No. 5,152,917 (Pieper et al.); U.S. Pat. No. 5,435,816 (Spurgeon et al.); U.S. Pat. No. 5,672,097 (Hoopman et al.); U.S. Pat. No. 5,946,991 (Hoopman et al.); U.S. Pat. No. 5,975,987 (Hoopman et al.); and U.S. Pat. No. 6,129,540 (Hoopman et al.); and in U.S. Publ. Pat. Appln. No. 2009/0165394 A1 (Culler et al.).

In some preferred embodiments, useful abrasive particles (especially in the case of the abrasive particles) may be shaped abrasive particles can be found in U.S. Pat. No. 5,201,916 (Berg); U.S. Pat. No. 5,366,523 (Rowenhorst (Re 35,570)); and U.S. Pat. No. 5,984,988 (Berg). U.S. Pat. No. 8,034,137 (Erickson et al.) describes alumina abrasive particles that have been formed in a specific shape, then crushed to form shards that retain a portion of their original shape features. In some embodiments, shaped alpha alumina particles are precisely-shaped (i.e., the particles have shapes that are at least partially determined by the shapes of cavities in a production tool used to make them. Details concerning such abrasive particles and methods for their preparation can be found, for example, in U.S. Pat. No. 8,142,531 (Adefris et al.); U.S. Pat. No. 8,142,891 (Culler et al.); and U.S. Pat. No. 8,142,532 (Erickson et al.); and in U.S. Pat. Appl. Publ. Nos. 2012/0227333 (Adefris et al.); 2013/0040537 (Schwabel et al.); and 2013/0125477 (Adefris). One particularly useful precisely-shaped abrasive particle shape is that of a truncated triangular pyramid with sloping sidewalls; for example as set forth in the above cited references.

Surface coatings on the abrasive particles may be used to improve the adhesion between the abrasive particles and a binder material, or to aid in electrostatic deposition of the abrasive particles. In one embodiment, surface coatings as described in U.S. Pat. No. 5,352,254 (Celikkaya) in an amount of 0.1 to 2 percent surface coating to abrasive particle weight may be used. Such surface coatings are described in U.S. Pat. No. 5,213,591 (Celikkaya et al.); U.S. Pat. No. 5,011,508 (Wald et al.); U.S. Pat. No. 1,910,444 (Nicholson); U.S. Pat. No. 3,041,156 (Rowse et al.); U.S. Pat. No. 5,009,675 (Kunz et al.); U.S. Pat. No. 5,085,671 (Martin et al.); U.S. Pat. No. 4,997,461 (Markhoff-Matheny et al.); and U.S. Pat. No. 5,042,991 (Kunz et al.). Additionally, the surface coating may prevent shaped abrasive particles from capping. Capping is the term to describe the phenomenon where metal particles from the workpiece being abraded become welded to the tops of the abrasive particles. Surface coatings to perform the above functions are known to those of skill in the art.

In some embodiments, the abrasive particles may be selected to have a length and/or width in a range of from 0.1 micrometers to 3.5 millimeters (mm), more typically 0.05 mm to 3.0 mm, and more typically 0.1 mm to 2.6 mm, although other lengths and widths may also be used.

The abrasive particles may be selected to have a thickness in a range of from 0.1 micrometer to 1.6 mm, more typically from 1 micrometer to 1.2 mm, although other thicknesses may be used. In some embodiments, abrasive particles may have an aspect ratio (length to thickness) of at least 2, 3, 4, 5, 6, or more.

Typically, crushed abrasive particles are independently sized according to an abrasives industry recognized specified nominal grade. Exemplary abrasive industry recognized grading standards include those promulgated by ANSI (American National Standards Institute), FEPA (Federation of European Producers of Abrasives), and JIS (Japanese Industrial Standard). Such industry accepted grading standards include, for example: ANSI 4, ANSI 6, ANSI 8, ANSI 16, ANSI 24, ANSI 30, ANSI 36, ANSI 40, ANSI 50, ANSI 60, ANSI 80, ANSI 100, ANSI 120, ANSI 150, ANSI 180, ANSI 220, ANSI 240, ANSI 280, ANSI 320, ANSI 360, ANSI 400, and ANSI 600; FEPA P8, FEPA P12, FEPA P16, FEPA P24, FEPA P30, FEPA P36, FEPA P40, FEPA P50, FEPA P60, FEPA P80, FEPA P100, FEPA P120, FEPA P150, FEPA P180, FEPA P220, FEPA P320, FEPA P400, FEPA P500, FEPA P600, FEPA P800, FEPA P1000, FEPA P1200; FEPA F8, FEPA F12, FEPA F16, and FEPA F24; and JIS 8, JIS 12, JIS 16, JIS 24, JIS 36, JIS 46, JIS 54, JIS 60, JIS 80, JIS 100, JIS 150, JIS 180, JIS 220, JIS 240, JIS 280, JIS 320, JIS 360, JIS 400, JIS 400, JIS 600, JIS 800, JIS 1000, JIS 1500, JIS 2500, JIS 4000, JIS 6000, JIS 8000, and JIS 10,000. More typically, the crushed aluminum oxide particles and the non-seeded sol-gel derived alumina-based abrasive particles are independently sized to ANSI 60 and 80, or FEPA F36, F46, F54 and F60 or FEPA P60 and P80 grading standards.

Alternatively, the abrasive particles can be graded to a nominal screened grade using U.S.A. Standard Test Sieves conforming to ASTM E-11 "Standard Specification for Wire Cloth and Sieves for Testing Purposes". ASTM E-11 prescribes the requirements for the design and construction of testing sieves using a medium of woven wire cloth mounted in a frame for the classification of materials according to a designated particle size. A typical designation may be represented as −18+20 meaning that the shaped abrasive particles pass through a test sieve meeting ASTM E-11 specifications for the number 18 sieve and are retained on a test sieve meeting ASTM E-11 specifications for the number 20 sieve. In one embodiment, the shaped abrasive particles have a particle size such that most of the particles pass through an 18 mesh test sieve and can be retained on a 20, 25, 30, 35, 40, 45, or 50 mesh test sieve. In various embodiments, the shaped abrasive particles can have a nominal screened grade comprising: −18+20, −201+25, −25+30, −30+35, −35+40, −40+45, −45+50, −50+60, −60+70, −70/+80, −80+100, −100+120, −120+140, −140+170, −170+200, −200+230, −230+270, −270+325, −325+400, −400+450, −450+500, or −500+635. Alternatively, a custom mesh size could be used such as −90+100.

A grinding aid is a material that has a significant effect on the chemical and physical processes of abrading, which results in improved performance. Grinding aids encompass a wide variety of different materials and can be inorganic or organic based. Examples of chemical groups of grinding aids include waxes, organic halide compounds, halide salts and metals and their alloys. The organic halide compounds will typically break down during abrading and release a halogen acid or a gaseous halide compound. Examples of such materials include chlorinated waxes like tetrachloronaphthalene, pentachloronaphthalene, and polyvinyl chloride. Examples of halide salts include sodium chloride, potassium cryolite, sodium cryolite, ammonium cryolite, potassium tetrafluoroborate, sodium tetrafluoroborate, silicon fluorides, potassium chloride, and magnesium chloride. Examples of metals include, tin, lead, bismuth, cobalt, antimony, cadmium, and iron titanium.

Other miscellaneous grinding aids include sulfur, organic sulfur compounds, graphite, and metallic sulfides. A combination of different grinding aids may be used, and in some instances this may produce a synergistic effect.

Grinding aids can be particularly useful in coated abrasives. In coated abrasive articles, grinding aid is typically used in a supersize coat, which is applied over the surface of the abrasive particles. Sometimes, however, the grinding aid is added to the size coat. Typically, the amount of grinding aid incorporated into coated abrasive articles are about 50-300 grams per square meter ($g/m^2$), preferably about 80-160 $g/m^2$.

Further details regarding coated abrasive articles and methods of their manufacture can be found, for example, in U.S. Pat. No. 4,734,104 (Broberg); U.S. Pat. No. 4,737,163 (Larkey); U.S. Pat. No. 5,203,884 (Buchanan et al.); U.S. Pat. No. 5,152,917 (Pieper et al.); U.S. Pat. No. 5,378,251 (Culler et al.); U.S. Pat. No. 5,436,063 (Follett et al.); U.S. Pat. No. 5,496,386 (Broberg et al.); U.S. Pat. No. 5,609,706 (Benedict et al.); U.S. Pat. No. 5,520,711 (Helmin); U.S. Pat. No. 5,961,674 (Gagliardi et al.), and U.S. Pat. No. 5,975,988 (Christianson).

Nonwoven abrasive articles typically include an open porous lofty fiber web having abrasive particles distributed throughout the structure and adherently bonded therein by a resole-phenolic-resin-based binder material according to the present disclosure. Examples of filaments include polyester fibers, polyamide fibers, and polyaramid fibers.

Figure 2A:
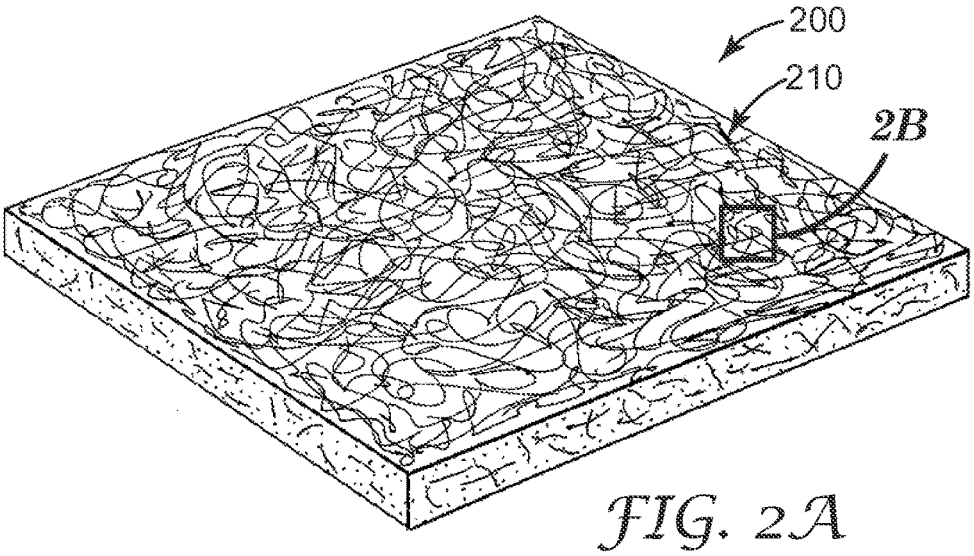
FIG. 2A is a perspective view of exemplary nonwoven abrasive article 200 according to the present disclosure.
Figure 2B:
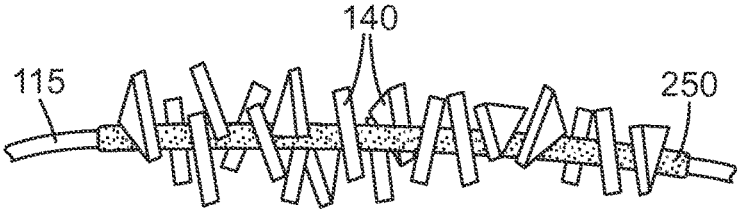
FIG. 2B is an enlarged view of region 2B of nonwoven abrasive article 200 shown in FIG. 2A.

An exemplary embodiment of a nonwoven abrasive article 200 is shown in FIGS. 2A and 2B. Referring now to FIGS. 2A and 2B, lofty open low-density fibrous web 210 is formed of entangled fibers 215. Abrasive particles 140 are secured to fibrous web 210 on exposed surfaces of fibers 215 by binder material 250, which also binds fibers 215 together at points where they contact one another, resulting in cutting points 150 being outwardly oriented relative to fibers 215.

Nonwoven fiber webs suitable for use are known in the abrasives art. Typically, the nonwoven fiber web comprises an entangled web of fibers. The fibers may comprise continuous fiber, staple fiber, or a combination thereof. For example, the fiber web may comprise staple fibers having a length of at least about 20 millimeters (mm), at least about 30 mm, or at least about 40 mm, and less than about 110 mm, less than about 85 mm, or less than about 65 mm, although shorter and longer fibers (e.g., continuous filaments) may also be useful. The fibers may have a fineness or linear density of at least about 1.7 decitex (dtex, i.e., grams/10000 meters), at least about 6 dtex, or at least about 17 dtex, and less than about 560 dtex, less than about 280 dtex, or less than about 120 dtex, although fibers having lesser and/or greater linear densities may also be useful. Mixtures of fibers with differing linear densities may be useful, for example, to provide an abrasive article that upon use will result in a specifically preferred surface finish. If a spunbond nonwoven is used, the filaments may be of substantially larger diameter, for example, up to 2 mm or more in diameter.

The fiber web may be made, for example, by conventional air laid, carded, stitch bonded, spun bonded, wet laid, and/or melt blown procedures. Air laid fiber webs may be prepared using equipment such as, for example, that available under the trade designation RANDO WEBBER from Rando Machine Company of Macedon, N.Y.

Nonwoven fiber webs are typically selected to be compatible with adhering binders and abrasive particles while also being compatible with other components of the article, and typically can withstand processing conditions (e.g., temperatures) such as those employed during application and curing of the curable binder precursor. The fibers may be chosen to affect properties of the abrasive article such as, for example, flexibility, elasticity, durability or longevity, abrasiveness, and finishing properties. Examples of fibers that may be suitable include natural fibers, synthetic fibers, and mixtures of natural and/or synthetic fibers. Examples of synthetic fibers include those made from polyester (e.g., polyethylene terephthalate), nylon (e.g., hexamethylene adipamide, polycaprolactam), polypropylene, acrylonitrile (i.e., acrylic), rayon, cellulose acetate, polyvinylidene chloride-vinyl chloride copolymers, and vinyl chloride-acrylonitrile copolymers. Examples of suitable natural fibers include cotton, wool, jute, and hemp. The fiber may be of virgin material or of recycled or waste material, for example, reclaimed from garment cuttings, carpet manufacturing, fiber manufacturing, or textile processing. The fiber may be homogenous or a composite such as a bicomponent fiber (e.g., a co-spun sheath-core fiber). The fibers may be tensilized and crimped, but may also be continuous filaments such as those formed by an extrusion process. Combinations of fibers may also be used.

Prior to coating and/or impregnation with a binder precursor composition, the nonwoven fiber web typically has a weight per unit area (i.e., basis weight) of at least about 50 grams per square meter (gsm), at least about 100 gsm, or at least about 150 gsm; and/or less than about 600 gsm, less than about 500 gsm, or less than about 400 gsm, as measured prior to any coating (e.g., with the curable binder precursor or optional pre-bond resin), although greater and lesser basis weights may also be used. In addition, prior to impregnation with the curable binder precursor, the fiber web typically has a thickness of at least about 3 mm, at least about 6 mm, or at least about 10 mm; and/or less than about 100 mm, less than about 50 mm, or less than about 25 mm, although greater and lesser thicknesses may also be useful.

Frequently, as known in the abrasives art, it is useful to apply a prebond resin to the nonwoven fiber web prior to coating with the curable binder precursor. The prebond resin serves, for example, to help maintain the nonwoven fiber web integrity during handling, and may also facilitate bonding of the urethane binder to the nonwoven fiber web. Examples of prebond resins include phenolic resins, urethane resins, hide glue, acrylic resins, urea-formaldehyde resins, melamine-formaldehyde resins, epoxy resins, and combinations thereof. The amount of pre-bond resin used in this manner is typically adjusted toward the minimum amount consistent with bonding the fibers together at their points of crossing contact. In those cases, wherein the nonwoven fiber web includes thermally bondable fibers, thermal bonding of the nonwoven fiber web may also be helpful to maintain web integrity during processing.

In those nonwoven abrasive articles including a lofty open nonwoven fiber web (e.g., hand pads, and surface conditioning discs and belts, flap brushes, or nonwoven abrasive webs used to make unitized or convolute abrasive wheels) many interstices between adjacent fibers that are substantially unfilled by the binder and abrasive particles, resulting in a composite structure of extremely low density having a network on many relatively large intercommunicated voids. The resulting lightweight, lofty, extremely open fibrous construction is essentially non-clogging and non-filling in nature, particularly when used in conjunction with liquids such as water and oils. These structures also can be readily cleaned upon simple flushing with a cleansing liquid, dried, and left for substantial periods of time, and then reused. Towards these ends, the voids in these nonwoven abrasive articles may make up at least about 75 percent, and preferably more, of the total space occupied by the composite structure.

One method of making nonwoven abrasive articles according to the present invention includes the steps in the following order: applying a prebond coating to the nonwoven fiber web (e.g., by roll-coating or spray coating), curing the prebond coating, impregnating the nonwoven fiber web with a make layer precursor that is a curable tacky binder material precursor according to the present disclosure (e.g., by roll-coating or spray coating), applying abrasive particles to the make layer precursor, at least partially curing make layer precursor, and then optionally applying a size layer precursor (e.g., as described herein above), and curing it and the make layer precursor (e.g., as described hereinabove), if necessary.

Further details regarding nonwoven abrasive articles and methods for their manufacture can be found, for example, in U.S. Pat. No. 2,958,593 (Hoover et al.); U.S. Pat. No. 4,227,350 (Fitzer); U.S. Pat. No. 4,991,362 (Heyer et al.); U.S. Pat. No. 5,712,210 (Windisch et al.); U.S. Pat. No. 5,591,239 (Edblom et al.); U.S. Pat. No. 5,681,361 (Sanders); U.S. Pat. No. 5,858,140 (Berger et al.); U.S. Pat. No. 5,928,070 (Lux); and U.S. Pat. No. 6,017,831 (Beardsley et al.).

In some embodiments, the substrate comprises a fiber scrim, for example, in the case of screen abrasives, or if included in bonded abrasives such as, for example, cutoff wheels and depressed center grinding wheels. Suitable fiber scrims may include woven, and knitted cloths, for example, which may include inorganic and/or organic fibers. For example, the fibers in the scrim may include wire, ceramic fiber, glass fiber (for example, fiberglass), and organic fibers (for example, natural and/or synthetic organic fibers). Examples of organic fibers include cotton fibers, jute fibers, and canvas fibers. Examples of synthetic fibers include nylon fibers, rayon fibers, polyester fibers, and polyimide fibers).

Abrasive articles according to the present disclosure are useful, for example, for abrading a workpiece. Such a method may comprise: frictionally contacting an abrasive articles according to the present disclosure with a surface of the workpiece, and moving at least one of the abrasive article and the surface of the workpiece relative to the other to abrade at least a portion of the surface of the workpiece. Methods for abrading with abrasive articles according to the present disclosure include, for example, snagging (i.e., high-pressure high stock removal) to polishing (e.g., polishing medical implants with coated abrasive belts), wherein the latter is typically done with finer grades (e.g., ANSI 220 and finer) of abrasive particles. The size of the abrasive particles used for a particular abrading application will be apparent to those skilled in the art.

Abrading may be carried out dry or wet. For wet abrading, the liquid may be introduced supplied in the form of a light mist to complete flood. Examples of commonly used liquids include: water, water-soluble oil, organic lubricant, and emulsions. The liquid may serve to reduce the heat associated with abrading and/or act as a lubricant. The liquid may contain minor amounts of additives such as bactericide, antifoaming agents, and the like.

Examples of workpieces include aluminum metal, carbon steels, mild steels (e.g., 1018 mild steel and 1045 mild steel), tool steels, stainless steel, hardened steel, titanium, glass, ceramics, wood, wood-like materials (e.g., plywood and particle board), paint, painted surfaces, and organic coated surfaces. The applied force during abrading typically ranges from about 1 to about 100 kilograms (kg), although other pressures can also be used.

SELECT EMBODIMENTS OF THE PRESENT DISCLOSURE

In a first embodiment, the present disclosure provides a method of making an abrasive article comprising:

disposing a curable tacky adhesive composition on a substrate, wherein the tacky curable adhesive composition comprises a resole phenolic resin and an aliphatic tack modifier, and wherein the amount of resole phenolic resin comprises from 60 to 98 weight percent of the combined weight of the resole phenolic resin and the aliphatic tack modifier;

adhering abrasive particles to the curable tacky adhesive composition; and at least partially curing the curable tacky adhesive composition.

In a second embodiment, the present disclosure provides a method according to the first embodiment, wherein the aliphatic tack modifier is selected from the group consisting of aliphatic rosins and derivatives thereof, aliphatic liquid hydrocarbon resins, aliphatic solid hydrocarbon resins, liquid natural rubbers, hydrogenated polybutadienes, polytetramethylene ether glycols, copolymers of isooctyl acrylate and acrylic acid, and aliphatic zwitterionic amphiphilic acrylic polymers.

In a third embodiment, the present disclosure provides a method according to the first or second embodiment, wherein the amount of resole phenolic resin comprises from 90 to 98 weight percent of the combined weight of the resole phenolic resin and the aliphatic tack modifier.

In a fourth embodiment, the present disclosure provides a method according to any one of the first to third embodiments, wherein the abrasive particles comprise shaped abrasive particles.

In a fifth embodiment, the present disclosure provides a method according to the fourth embodiment, wherein the shaped abrasive particles comprise precisely-shaped abrasive particles.

In a sixth embodiment, the present disclosure provides a method according to the fourth embodiment, wherein the shaped abrasive particles comprise precisely-shaped triangular platelets.

In a seventh embodiment, the present disclosure provides a method according to any one of the first to sixth embodiments, wherein the substrate comprises a planar backing member having first and second opposed major surfaces, the method further comprising:

disposing a size layer precursor onto at least a portion of the abrasive particles and said at least partially curing the curable tacky adhesive composition; and at least partially curing the size layer precursor to provide a coated abrasive article.

In an eighth embodiment, the present disclosure provides a method according to any one of the first to sixth embodiments, wherein the substrate comprises a lofty open nonwoven fiber web.

In a ninth embodiment, the present disclosure provides a method according to any one of the first to sixth embodiments, wherein the substrate comprises a fiber scrim.

In a tenth embodiment, the present disclosure provides an abrasive article comprising abrasive particles adhered to a substrate by a binder material comprising an at least partially cured resole phenolic resin and an aliphatic tack modifier, wherein the amount of resole phenolic resin comprises from 60 to 98 weight percent of the combined weight of the resole phenolic resin and the aliphatic tack modifier.

In an eleventh embodiment, the present disclosure provides an abrasive article according to the tenth embodiment, wherein the aliphatic tack modifier is selected from the group consisting of rosin ester tackifiers, liquid hydrocarbon resin tackifiers, solid hydrocarbon resin tackifiers, liquid natural rubbers, hydrogenated polybutadienes, polytetramethylene ether glycols, copolymers of isooctyl acrylate and acrylic acid, and aliphatic zwitterionic amphiphilic acrylic polymers.

In a twelfth embodiment, the present disclosure provides an abrasive article according to the tenth or eleventh embodiment, wherein the amount of resole phenolic resin comprises from 90 to 98 weight percent of the combined weight of the resole phenolic resin and the aliphatic tack modifier.

In a thirteenth embodiment, the present disclosure provides an abrasive article according to any one of the tenth to twelfth embodiments, wherein the abrasive particles comprise shaped abrasive particles.

In a fourteenth embodiment, the present disclosure provides an abrasive article according to the thirteenth embodiment, wherein the shaped abrasive particles comprise precisely-shaped abrasive particles.

In a fifteenth embodiment, the present disclosure provides an abrasive article according to the thirteenth embodiment, wherein the shaped abrasive particles comprise precisely-shaped triangular platelets.

In a sixteenth embodiment, the present disclosure provides an abrasive article according to any one of the tenth to fifteenth embodiments, wherein the abrasive article is a coated abrasive article.

In a seventeenth embodiment, the present disclosure provides an abrasive article according to any one of the tenth to fifteenth embodiments, wherein the abrasive article is a nonwoven abrasive article.

In an eighteenth embodiment, the present disclosure provides an abrasive article according to any one of the tenth to fifteenth embodiments, wherein the substrate comprises a fiber scrim.

Objects and advantages of this disclosure are further illustrated by the following non-limiting examples, but the particular materials and amounts thereof recited in these examples, as well as other conditions and details, should not be construed to unduly limit this disclosure.

EXAMPLES

Unless otherwise noted, all parts, percentages, ratios, etc. in the Examples and the rest of the specification are by weight. Materials used in the Examples are reported in Table 1, below.

TABLE 1

| ABBREVIATION | DESCRIPTION |
|---|---|
| PF1 | Resole phenol-formaldehyde resin having a phenol to formaldehyde weight ratio of 1.5-2.1/1, and catalyzed with 2.5 percent potassium hydroxide |
| PF2 | Resole - phenol-formaldehyde resin obtained as ARCLIN 80-5077A from Arclin, Ste-Therese, Quebec, Canada |
| PF3 | Resole phenol-formaldehyde resin obtained as HJR16304 from SI Group Inc., Schenectady, New York |
| BACK1 | Polyester backing described in Example 12 of U.S. Pat. No. 6,843,815 (Thurber et al.) |
| FIL1 | Calcium carbonate obtained as Q325 from Huber Engineered Materials, Atlanta, Georgia |
| FIL2 | Calcium silicate obtained as M400 WOLLASTOCOAT from NYCO, Willsboro, New York |
| FIL3 | Cryolite obtained under the trade designation CRYOLITE RTN-C from FREEBEE A/S, Ullerslev, Denmark. |
| RIO | Red iron oxide pigment, obtained under the trade designation KROMA RO-3097 from Elementis, East Saint Louis, Illinois |
| MIN1 | Shaped abrasive particles prepared according to the disclosure of U.S. Pat. No. 8,142,531(Adefris et al.). The shaped abrasive particles were prepared by molding alumina sol-gel in equilateral triangle-shaped polypropylene mold cavities of side length 0.110 inch (2.8 mm) and a mold depth of 0.028 inch (0.71 mm). The fired shaped abrasive particles were about 1.37 mm (side length) × 0.027 mm thick and would pass through an ASTM 45 (Tyler equivalent 42)-mesh sieve. |
| MIN2 | ANSI grade 36 aluminum oxide abrasive mineral, obtained under the trade designation DURALUM G52 BROWN ALUMINUM OXIDE GRADE 36 from Washington Mills Electro Minerals Corporation, Niagara Falls, New York |
| MIN3 | Shaped abrasive particles prepared according to the disclosure of U.S. Pat. No. 8,142,531 (Adefris et al.). The shaped abrasive particles were prepared by molding alumina sol gel in equilateral triangle-shaped polypropylene mold cavities of side length 0.110 inch (2.8 mm) and a mold depth of 0.028 inch (0.71 mm). The fired shaped abrasive particles were about 1.37 mm (side length) × 0.027 mm thick and would pass through an ASTM 16 (Tyler equivalent 14) mesh sieve. |
| HMA | A polyamide hot melt adhesive obtained under the trade designation JET MELT BRAND ADHESIVE PG3779 from 3M Company, Saint Paul, Minnesota |
| AD1 | A rosin ester dispersion obtained as AQUATAC 6085 from Arizona Chemical, Jacksonville, Florida. |
| AD2 | An aliphatic liquid hydrocarbon resin obtained as PICCOTAC 1020 from Eastman Chemical Company, Kingsport, Tennessee. |
| AD3 | A solid aliphatic hydrocarbon resin obtained as PICCOTAC 1095 from Eastman Chemical Company. |

TABLE 1-continued

| ABBREVIATION | DESCRIPTION |
|---|---|
| AD4 | A liquid natural rubber obtained as DPR-35 from DPR Industries, Coatesville, Pennsylvania. |
| AD5 | A liquid natural rubber obtained as DPR-40 from DPR Industries |
| AD6 | Hydrogenated polybutadiene obtained as KRATON LIQUID L1203 from Kraton Polymers US LLC, Houston, TX. |
| AD9 | A polytetramethylene ether glycol obtained as TETRATHANE 650 from Invista, Waynesboro, Virginia. |
| AD10 | Aqueous non-carboxylated butadiene-styrene copolymer dispersion (pH 10.4) obtained as BUTONAL NS104 from BASF Corporation, Charlotte, North Carolina. |
| AD11 | Aqueous dispersion of a styrene/butadiene copolymer containing carboxyl groups (pH 6.8) obtained as BUTOFAN NS 144 from BASF Corporation. |
| AD12 | Aqueous dispersion of a styrene-butadiene copolymer containing carboxyl groups (pH 8.8) obtained as BUTOFAN NS166 from BASF Corporation. |
| AD13 | Aqueous dispersion of styrene-butadiene copolymer (pH 10.5) obtained as BUTOFAN 4202 from BASF Corporation |
| AD14 | A carboxylated styrene-butadiene copolymer dispersion (pH 8.2-9.0) obtained as BUTOFAN NS209 from BASF Corporation |
| AD15 | Aqueous and carboxylated styrene-butadiene copolymer dispersion (pH 8.8) obtained as BUTOFAN NS 222 from BASF Corporation |
| AD16 | Aqueous non-carboxylated butadiene-styrene copolymer dispersion (pH 11.4) obtained as BUTOFAN NS 299 from BASF Corporation |
| AD17 | isooctyl acrylate-acrylic acid (95:5) copolymer as described in U.S. Pat. No. 4,418,120 (Kealy et. al) page 6, line 51, Example A. |
| AD18 | aliphatic acrylic zwitterionic amphiphilic polymer emulsion as described in U.S. Pat. Appln. Publ. 2014/0170362 A1 (Ali et al.) in Example 20 in Table 9. |

Tackiness Test

A 75 cm by 100 cm piece of production tool as described in Example 1 of WO 2015/100018 (Culler et al.) was filled with MIN3 and manually placed onto the adhesive side of BACK1 coated with and Example or Comparative Example make coating composition and then removed. The evaluated make coating composition was considered to have appropriate adhesive tackiness if MIN3 was retained in make coating layer and no substantial amount of make adhesive transferred to production tool.

Peel Adhesion Test

Examples 52 through 57 and Comparative Examples AS and AT were converted into 8 cm wide by 25 cm long test specimens. One-half the length of a wooden board (17.8 cm by 7.6 cm by 0.6 cm) is coated with HMA applied with a hot melt glue gun (commercially available under the trade designation "POLYGUN II HOT MELT APPLICATOR" from 3M Company). The entire width of, but only the first 15 cm of the length of, the coated abrasive article was coated with laminating adhesive on the side bearing the abrasive particles. The side of the coated abrasive article bearing the abrasive particles was attached to the side of the board containing the laminating adhesive coating in such a manner that the 10 cm of the coated abrasive article not bearing the laminating adhesive overhangs from the board. Pressure was applied such that the board and the coated abrasive article become intimately bonded. Operating at 25° C., the abrasive article to be tested is cut along a straight line on both sides of the article such that the width of the coated abrasive article is reduced to 5.1 cm. The resulting abrasive article/board composite is mounted horizontally in a fixture attached to the upper jaw of a tensile testing machine, commercially available under the trade designation "SINTECH 6W" from MTS Systems Corp., Eden Prairie, Minn. Approximately 1 cm of the overhanging portion of the coated abrasive article was mounted into the lower jaw of the machine such that the distance between the jaws was 12.7 cm. The machine separated the jaws at a rate of 0.05 centimeter/second (cm/sec), with the coated abrasive article being pulled at an angle of 90° away from the wooden board so that a portion of the coated abrasive article separated from the board. The force required for such separation (i.e., stripback force) is reported in Newton/meter (N/m).

Grinding Test

The Grinding Test was conducted on 10.16 cm by 91.44 cm belts converted from coated abrasives samples The workpiece was a 304 stainless steel bar on which the surface to be abraded measured 1.9 cm by 1.9 cm. A 20.3 cm diameter 70 durometer rubber, 1:1 land to groove ratio, serrated contact wheel was used. The belt was run at 2750 rpm. The workpiece was applied to the center part of the belt at a normal force 4.4 kg. The test consisted of measuring the weight loss of the workpiece after 15 seconds of grinding. The workpiece would then be cooled and tested again. The test was concluded after 40 cycles. The initial cut in grams was defined at total cut after 2 cycles, cut rate in gram was defined at total cut of 10 cycles minus total cut of 3 cycles divided by seven. The total cut in grams was defined has total cut after 40 cycles.

Procedures for Preparing Make Adhesive Compositions

Preparative Example PE1

A 120 ml glass jar was charged with 80 grams (g) of PF1, 10 g of AD1 and 10 g of AD2. The components were mixed with a mechanical mixer for about 15 minutes to yield a uniform mix.

Preparative Examples PE2-PE27 and Comparative Examples B-W

Examples PE2 through PE27 and Comparative Examples B-W were made identically to Example PE1 with the exception that the components were as shown in Tables 2A and 2B, which is a continuation of ingredients listed in Table 2A. To determine composition, both of Tables 2A and 2B should be consulted.

Comparative Example A

A 120 ml glass jar was charged with 67 g of PF1 and 52 g of FIL2. The components were mixed with a mechanical mixer for about 15 minutes to yield a uniform mix.

TABLE 2A

| | COMPONENTS | | | | | | | | | | | |
|---|---|---|---|---|---|---|---|---|---|---|---|---|
| EXAMPLE | PF1 | PF2 | PF3 | FIL1 | FIL2 | AD1 | AD2 | AD3 | AD4 | AD5 | AD6 | AD9 |
| PE1 | 80 | | | | | 10 | 10 | | | | | |
| Comp. Ex A | | | 70 | | | 10 | | | | | | |
| Comp. Ex B | 30 | | | | | 10 | | | | | | |
| Comp. Ex C | 30 | | | | | | | | | | | |
| Comp. Ex D | 30 | | | 30 | | | | | | | | |
| Comp. Ex E | 30 | | | | 30 | | | | | | | |
| Comp. Ex F | 70 | | | | | 10 | | | | | | |
| Comp. Ex G | 70 | | | | | | | | | | | |
| Comp. Ex H | 70 | | | | | | | | | | | |
| Comp. Ex I | 70 | | | | | 10 | | | | | | |
| Comp. Ex J | 30 | | | | | | | | | | | |
| Comp. Ex K | 30 | | | | | 10 | | | | | | |
| Comp. Ex L | 50 | | | | | | | | | | | |
| Comp. Ex M | 50 | | | | | 10 | | | | | | |
| Comp. Ex N | 90 | | | | | | | | | | | |
| PE2 | 80 | | | | | 10 | | | 10 | | | |
| PE3 | 80 | | | | | 10 | | | | 10 | | |
| Comp. Ex O | 70 | | | | | | | | | | | |
| Comp. Ex P | 70 | | | | | 10 | | | | | | |
| Comp. Ex Q | 30 | | | | | | | | | | | |
| Comp. Ex R | 50 | | | | | | | | | | | |
| Comp. Ex S | 50 | | | | | 10 | | | | | | |
| Comp. Ex T | 95 | | | | | | | | | | | |
| PE4 | 90 | | | | | | | | | | | 10 |
| PE5 | 90 | | | | | | | | | | 10 | |
| PE6 | 95 | | | | | | | | | | | |
| PE7 | 90 | | | | | | | | | | | |
| PE8 | 50 | | | | | | | | | | | |
| PE9 | 70 | | | | | | | | | | | |
| PE10 | 90 | | | | | | | | | | | |
| PE11 | 95 | | | | | | | | | | | |
| PE12 | 70 | | | 45 | | | | | | | | |
| PE13 | 70 | | | | 45 | | | | | | | |
| PE14 | 90 | | | 50 | | | | | | | | |
| PE15 | 90 | | | | 50 | | | | | | | |
| PE16 | 95 | | | 50 | | | | | | | | |
| PE17 | 95 | | | | 50 | | | | | | | |
| PE18 | 95 | | | | 70 | | | | | | | |
| PE19 | 50 | | | 70 | | | | | | | | |
| PE20 | 70 | | | 70 | | | | | | | | |
| PE21 | 80 | | | 70 | | | | | | | | |
| PE22 | 90 | | | 70 | | | | | | | | |
| PE23 | 95 | | | 70 | | | | | | | | |
| PE24 | 68.7 | | | 23.3 | | | 8 | | | | | |
| PE25 | 68.7 | | | | 23.3 | | 8 | | | | | |
| PE26 | | 90 | | | | | | | | | | |
| Comp. Ex U | 90 | | | | | | | | | | | |
| Comp. Ex V | 95 | | | | | | | | | | | |
| PE27 | 95 | | | | | | | 5 | | | | |
| Comp. Ex. W | 65 | | | | 52 | | | | | | | |

TABLE 2B

| | COMPONENTS | | | | | | | | | |
|---|---|---|---|---|---|---|---|---|---|---|
| EXAMPLE | AD10 | AD11 | AD12 | AD13 | AD14 | AD15 | AD16 | AD17 | AD18 | COMMENT |
| PE1 | | | | | | | | | | Uniform Appearance |
| Comp. Ex A | | | | | 20 | | | | | Uniform Appearance |
| Comp. Ex B | | | | | 70 | | | | | Uniform Appearance |
| Comp. Ex C | | | | | 70 | | | | | Uniform Appearance |
| Comp. Ex D | | | | | 70 | | | | | Uniform Appearance |

TABLE 2B-continued

| | COMPONENTS | | | | | | | | | |
|---|---|---|---|---|---|---|---|---|---|---|
| EXAMPLE | AD10 | AD11 | AD12 | AD13 | AD14 | AD15 | AD16 | AD17 | AD18 | COMMENT |
| Comp. Ex E | | | | | 70 | | | | | Uniform Appearance |
| Comp. Ex F | | | | | 30 | | | | | Uniform Appearance |
| Comp. Ex G | | | | | 30 | | | | | Uniform Appearance |
| Comp. Ex H | | 30 | | | | | | | | Uniform Appearance |
| Comp. Ex I | | 30 | | | | | | | | Uniform Appearance |
| Comp. Ex J | | 70 | | | | | | | | Uniform Appearance |
| Comp. Ex K | | 70 | | | | | | | | Uniform Appearance |
| Comp. Ex L | | 50 | | | | | | | | Uniform Appearance |
| Comp. Ex M | | 50 | | | | | | | | Uniform Appearance |
| Comp. Ex N | | | | | | | 10 | | | Phase separation |
| PE2 | | | | | | | | | | Uniform Appearance |
| PE3 | | | | | | | | | | Uniform Appearance |
| Comp. Ex O | | | | | | 30 | | | | Uniform Appearance |
| Comp. Ex P | | | | | | 30 | | | | Uniform Appearance |
| Comp. Ex Q | | | | | | 70 | | | | Uniform Appearance |
| Comp. Ex R | | | | | | 50 | | | | Uniform Appearance |
| Comp. Ex S | | | | | | 50 | | | | Uniform Appearance |
| Comp. Ex T | | | | 5 | | | | | | Uniform Appearance |
| PE4 | | | | | | | | | | Uniform Appearance |
| PE5 | | | | | | | | | | Uniform Appearance |
| PE6 | | | | | | | | 5 | | Phase separation |
| PE7 | | | | | | | | 10 | | Phase separation |
| PE8 | | | | | | | | | 50 | Uniform Appearance |
| PE9 | | | | | | | | | 30 | Uniform Appearance |
| PE10 | | | | | | | | | 10 | Uniform Appearance |
| PE11 | | | | | | | | | 5 | Uniform Appearance |
| PE12 | | | | | | | | | 30 | Uniform Appearance |
| PE13 | | | | | | | | | 30 | Uniform Appearance |
| PE14 | | | | | | | | | 10 | Uniform Appearance |
| PE15 | | | | | | | | | 10 | Uniform Appearance |
| PE16 | | | | | | | | | 5 | Uniform Appearance |
| PE17 | | | | | | | | | 5 | Uniform Appearance |
| PE18 | | | | | | | | | 5 | Uniform Appearance |
| PE19 | | | | | | | | | 50 | Uniform Appearance |
| PE20 | | | | | | | | | 30 | Uniform Appearance |
| PE21 | | | | | | | | | 20 | Uniform Appearance |
| PE22 | | | | | | | | | 10 | Uniform Appearance |
| PE23 | | | | | | | | | 5 | Uniform Appearance |

TABLE 2B-continued

| EXAMPLE | COMPONENTS | | | | | | | | | COMMENT |
|---|---|---|---|---|---|---|---|---|---|---|
| | AD10 | AD11 | AD12 | AD13 | AD14 | AD15 | AD16 | AD17 | AD18 | |
| PE24 | | | | | | | | | 10 | Uniform Appearance |
| PE25 | | | | | | | | | 10 | Uniform Appearance |
| PE26 | | | | | | | | | 10 | Uniform Appearance |
| Comp. Ex U | | | | | 10 | | | | | Uniform Appearance |
| Comp. Ex V | | | 5 | | | | | | | Phase separation |
| PE27 | | | | | | | | | | Phase separation |
| Comp. Ex. W | | | | | | | | | | Uniform Appearance |

Procedures for Coating Make Adhesive Compositions onto Backing

Example 28

The make adhesive composition of Example 1 was applied to a 15 cm by 20 cm sample of BACK1 at a 101.6 micrometer wet thickness using a 10 cm wide coating knife from Paul N. Gardner Company, Pompano Beach, Fla., having a blade gap of 101.6 micrometer. The resultant coating was evaluated by the Tackiness Test and the results reported in Table 3.

Examples 29-51 and Comparative Examples X-AQ

Examples 29-51 and Comparative Examples X-AQ were prepared identically to Example 28 with the exception that the make adhesive compositions were those as shown in Table 3. The coatings were evaluated by the Tackiness Test and the results reported in Table 3.

Comparative Example AR

The make adhesive composition of Comparative Example W was applied to a 15 cm by 20 cm sample of BACK1 at a 101.6 micrometer wet thickness using a 10 cm wide coating knife from Paul N. Gardner Company, Pompano Beach, Fla., having a blade gap of 101.6 micrometers. The coating was evaluated by the Tackiness Test and the results reported in Table 3, below.

TABLE 3

| MAKE COATING EXAMPLES | MAKE ADHESIVE COMPOSITION | TACKINESS TEST RESULT |
|---|---|---|
| 28 | Example 1 | Tacky with no residue transfer |
| Comp. Ex. X | Comp. Ex. A | Not tacky |
| Comp. Ex. Y | Comp. Ex. B | Only tacky upon heating |
| Comp. Ex. Z | Comp. Ex. C | Only tacky upon heating |
| Comp. Ex. AA | Comp. Ex. D | Only tacky upon heating |
| Comp. Ex. AB | Comp. Ex. E | Only tacky upon heating |
| Comp. Ex. AC | Comp. Ex. F | Tacky but residue transfer |
| Comp. Ex. AD | Comp. Ex. G | Tacky but residue transfer |
| Comp. Ex. AE | Comp. Ex. H | Tacky but residue transfer |

TABLE 3-continued

| MAKE COATING EXAMPLES | MAKE ADHESIVE COMPOSITION | TACKINESS TEST RESULT |
|---|---|---|
| Comp. Ex. AF | Comp. Ex. I | Tacky but residue transfer |
| Comp. Ex. AG | Comp. Ex. J | Not tacky |
| Comp. Ex. AH | Comp. Ex. K | Not tacky |
| Comp. Ex. AI | Comp. Ex. L | Not tacky |
| Comp. Ex. AJ | Comp. Ex. M | Not tacky |
| 29 | Example 2 | Tacky with no residue transfer |
| 30 | Example 3 | Tacky with no residue transfer |
| Comp. Ex. AK | Comp. Ex. O | Tacky but residue transfer |
| Comp. Ex. AL | Comp. Ex. P | Tacky but residue transfer |
| Comp. Ex. AM | Comp. Ex. Q | Tacky but residue transfer |
| Comp. Ex. AN | Comp. Ex. R | Tacky but residue transfer |
| Comp. Ex. AO | Comp. Ex. S | Not tacky |
| Comp. Ex. AP | Comp. Ex. T | Tacky but residue transfer |
| 31 | Example 4 | Tacky but residue transfer |
| 32 | Example 5 | Tacky but residue transfer |
| 33 | Example 8 | Tacky with no residue transfer |
| 34 | Example 9 | Tacky with no residue transfer |
| 35 | Example 10 | Tacky with no residue transfer |
| 36 | Example 11 | Tacky with no residue transfer |
| 37 | Example 12 | Tacky with no residue transfer |
| 38 | Example 13 | Tacky with no residue transfer |
| 39 | Example 14 | Tacky with no residue transfer |
| 40 | Example 15 | Tacky with no residue transfer |
| 41 | Example 16 | Tacky with no residue transfer |
| 42 | Example 17 | Tacky with no residue transfer |
| 43 | Example 18 | Tacky with no residue transfer |
| 44 | Example 19 | Tacky with no residue transfer |
| 45 | Example 20 | Tacky with no residue transfer |
| 46 | Example 21 | Tacky with no residue transfer |

TABLE 3-continued

| MAKE COATING EXAMPLES | MAKE ADHESIVE COMPOSITION | TACKINESS TEST RESULT |
|---|---|---|
| 47 | Example 22 | Tacky with no residue transfer |
| 48 | Example 23 | Tacky with no residue transfer |
| 49 | Example 24 | Tacky with no residue transfer |
| 50 | Example 25 | Tacky with no residue transfer |
| 51 | Example 26 | Tacky but with residue transfer |
| Comp. Ex. AQ | Comparative Example U | Tacky but residue transfer |
| Comp. Ex. AR | Comparative Example W | Tacky but residue transfer |

Size Coat Composition

A conventional coated abrasive size adhesive composition was prepared by charging a 3 liter plastic container with 431.5 grams of PF1, 227.5 gram of FIL2, 227.5 grams of FIL3 and 17 g of RIO, mechanically mixing and then diluting to a total weight of 1 kilogram with water.

Coated Abrasive Preparation

Example 52

The make adhesive composition of Example 1 was applied to BACK1 at a 76 micrometer wet thickness and 20° C. using a 10 cm wide coating knife (described above) having a blade gap of 101.6 micrometer. The resultant make coat was allowed to dry overnight. MIN 1 was electrostatically coated onto the make coat at a coverage of 441 gram per square meter and the resultant product was then cured at 90° C. for 90 minutes and 102° C. for 60 minutes. After cooling, the conventional size adhesive was applied at a coverage rate of 483 grams per square meter with a 75 cm paint roller and resultant product was cured at 90° C. for 60 minutes and at 102° C. for 8 hours more.

Comparative Example AS

The make adhesive composition of Comparative Example B was applied to BACK1 at a 76 micrometer wet thickness and 20° C. using a 10 cm wide coating knife (described above) having a blade gap of 101.6 micrometer. The make coat was allowed to dry overnight. The make coating was heated with a heat gun to about 90° C. and MIN 1 was electrostatically coated onto the make coat at a coverage of 403 gram per square meter and the resultant product was then cured at 90° C. for 90 minutes and 102° C. for 60 minutes. The make coat needed to be heated in order to have enough tack to hold MIN 1. After cooling, the conventional size coat was applied at a coverage rate of 483 grams per square meter with a 75 cm paint roller and resultant product was cured at 90° C. for 60 minutes and at 102° C. for 8 hours more.

Example 53

The make adhesive composition of Example 23 was applied to BACK1 at a 101.6 micrometer (um) wet thickness and 20° C. using a 10 cm wide coating knife (described above) having a blade gap of 101.6 um. MIN 2 was drop coated onto the make coat at a coverage of 861 grams per square meter and the resultant product was then cured at 90° C. for 90 minutes and 102° C. for 60 minutes. After cooling, the conventional size coat was applied at a coverage rate of grams per square meter with a 75 cm paint roller and resultant product was cured at 90° C. for 60 minutes and then at 102° C. for 8 hours more.

Examples 54 Through 57

The coated abrasive examples 54 to 57 were prepared identically to Example 53 except for the compositions, which are summarized in Table 4.

The coated abrasive articles of Examples 52 through 57 and Comparative Examples AS and AT were evaluated by the Peel Adhesion Test. Test results are reported in Table 4.

Supersize Coat Composition

A conventional supersize composition was prepared according to Example 26 of U.S. Pat. No. 5,441,549 (Helmin) starting at column 21, line 10.

Example 58

The make coat adhesive composition of Example 16 was applied to BACK1 at a 75 micrometer (um) wet thickness and 20° C. using a 10 cm wide coating knife (described above) having a blade gap of 75 um. The make coat weight coverage was 168 grams per square meter. MIN3 was electrostatically coated onto the make coat at a coverage of 546 gram per square meter and the resultant product was then cured at 90° C. for 90 minutes and 102° C. for 60 minutes. After cooling, the conventional size adhesive was applied at a coverage rate of grams per square meter with a 75 cm paint roller and resultant product was cured at 90° C. for 60 minutes and then at 102° C. for 60 minutes. Next, the resultant product was supersized using a 75 cm paint roller with a coverage of 462 grams per meter square. The product was cured at 90 C for 30 minutes, 8 hours at 102 C and 60 minutes at 109 C.

Example 59

The make adhesive composition of Example 16 was applied to BACK1 at a 75 micrometer (um) wet thickness and 20° C. using a 10 cm wide coating knife (described above) having a blade gap of 75 um. The make weight coverage was 168 grams per square meter. A 75 cm by 100 cm piece of production tool as described in Example 1 of WO 2015100018 was filled with MIN3 and then placed onto make coating and then removed to leave a mineral weight addition of 546 g. This mineral coating process was repeated to get desired length of belt. The resultant product was then cured at 90° C. for 90 minutes and at 102° C. for 60 minutes. After cooling, the conventional size adhesive was applied at a coverage rate of 504 grams per square meter with a 75 cm paint roller and then cured at 90° C. for 60 minutes and then at 102° C. for 60 minutes. Next, the resultant product was coated with conventional supersize coat using a 75 cm paint roller with a coverage of 462 grams per meter square. The product was cured at 90° C. for 30 minutes, 8 hours at 102° C. and 60 minutes at 109 C.

Examples 60 and 61

Examples 60 and 61 were prepared identically to Example 59 with the exception that the compositions were adjusted as summarized in Table 5.

Comparative Example AT

The make adhesive of Comparative Example W was applied to BACK1 at a 101.6 micrometer (um) wet thickness and 20° C. using a 10 cm wide coating knife (described above) having a blade gap of 101.6 um. MIN2 was drop coated onto the make coat at a coverage of 861 gram per square meter and the resultant product was then cured at 90° C. for 90 minutes and 102° C. for 60 minutes. After cooling, the conventional size coat was applied at a coverage rate of grams per square meter with a 75 cm paint roller and resultant product was cured at 90° C. for 60 minutes and then at 102° C. for 8 hours more.

Comparative Example AU

Comparative Example AU was a commercially-available belt with trade designation 984F 36+ CUBITRON II METALWORKING BELT, available from 3M, Saint Paul, Minn.

Examples 105 through 108 and Comparative Examples C and D were evaluated using the Grinding Test. Test results are shown in Table 6.

TABLE 4

| EXAMPLE | MAKE ADHESIVE COMPOSITION | MAKE THICKNESS (μM) | MINERAL TYPE | MINERAL WT. (GSM) | SIZE (GSM) | 90 DEGREE T-PEEL ADHESION TEST 1 (NEWTON/METER) | 90 DEGREE T PEEL ADHESION TEST 2 (NEWTON/METER) |
|---|---|---|---|---|---|---|---|
| 52 | Example 1 | 76 | MIN1 | 441 | 483 | 6690 | NA |
| Comp. Ex AS | Comp. Ex. B | 76 | MIN1 | 403 | 483 | 877 | NA |
| 53 | Example 19 | 101 | MIN2 | 861 | 567 | 2855 | 4256 |
| 54 | Example 20 | 101 | MIN2 | 861 | 567 | 6199 | 6322 |
| 55 | Example 21 | 101 | MIN2 | 861 | 567 | 6497 | 6655 |
| 56 | Example 22 | 101 | MIN2 | 861 | 567 | 6515 | 6042 |
| 57 | Example 23 | 101 | MIN2 | 861 | 567 | 6637 | 6760 |
| Comparative Example AT | Comparative Example W | 101 | MIN2 | 861 | 567 | 7095 | 6567 |

TABLE 5

| EXAMPLE | MAKE ADHESIVE COMPOSITION | MAKE WT. (GSM) | MINERAL WT. (GSM) | SIZE WT. (GSM) | SUPERSIZE WT. (GSM) |
|---|---|---|---|---|---|
| 58 | Example 12 | 168 | 546 | 504 | 462 |
| 59 | Example 12 | 168 | 546 | 504 | 462 |
| 60 | Example 14 | 168 | 546 | 504 | 462 |
| 61 | Example 16 | 168 | 546 | 504 | 462 |

TABLE 6

| EXAMPLE | INITIAL CUT, g | % OF COMPARATIVE EXAMPLE AU | CUT RATE, g | % OF COMPARATIVE EXAMPLE AU | TOTAL CUT, g | % OF COMPARATIVE EXAMPLE AU |
|---|---|---|---|---|---|---|
| 58 | 53.4 | 99 | 19.2 | 109 | 666.1 | 115 |
| 59 | 61.7 | 114 | 21 | 132 | 640.6 | 110 |
| 60 | 61.8 | 115 | 25.4 | 141 | 681.5 | 117 |
| 61 | 58 | 108 | 27.1 | 120 | 578.6 | 100 |
| Comparative Example AU | 53.9 | 100 | 19.2 | 100 | 581.3 | 100 |

All cited references, patents, and patent applications in the above application for letters patent are herein incorporated by reference in their entirety in a consistent manner. In the event of inconsistencies or contradictions between portions of the incorporated references and this application, the information in the preceding description shall control. The preceding description, given in order to enable one of ordinary skill in the art to practice the claimed disclosure, is not to be construed as limiting the scope of the disclosure, which is defined by the claims and all equivalents thereto.

What is claimed is:

1. A method of making an abrasive article comprising:

disposing a curable tacky adhesive composition on a substrate, wherein the tacky curable adhesive composition comprises a resole phenolic resin and an aliphatic tack modifier, and wherein the amount of resole phenolic resin comprises from 90 to 98 weight percent of the combined weight of the resole phenolic resin and the aliphatic tack modifier;

adhering abrasive particles to the curable tacky adhesive composition; and at least partially curing the curable tacky adhesive composition.

2. The method of claim 1, wherein the aliphatic tack modifier is selected from the group consisting of aliphatic rosins and derivatives thereof, liquid hydrocarbon resins, solid hydrocarbon resins, liquid natural rubbers, hydrogenated polybutadienes, polytetramethylene ether glycols, copolymers of isooctyl acrylate and acrylic acid, and aliphatic zwitterionic amphiphilic acrylic polymers.

3. The method of claim 1, wherein the abrasive particles comprise shaped abrasive particles.

4. The method of claim 3, wherein the shaped abrasive particles comprise precisely-shaped abrasive particles.

5. The method of claim 3, wherein the shaped abrasive particles comprise precisely-shaped triangular platelets.

6. The method of claim 1, wherein the substrate comprises a planar backing member having first and second opposed major surfaces, the method further comprising:

disposing a size layer precursor onto at least a portion of the abrasive particles and said at least partially curing the curable tacky adhesive composition; and at least partially curing the size layer precursor to provide a coated abrasive article.

7. The method of claim 1, wherein the substrate comprises a lofty open nonwoven fiber web.

8. The method of claim 1, wherein the substrate comprises a fiber scrim.

9. An abrasive article comprising abrasive particles adhered to a substrate by a binder material comprising an at least partially cured resole phenolic resin and an aliphatic tack modifier, wherein the amount of resole phenolic resin comprises from 90 to 98 weight percent of the combined weight of the resole phenolic resin and the aliphatic tack modifier.

10. The abrasive article of claim 9, wherein the aliphatic tack modifier is selected from the group consisting of aliphatic rosins and derivatives thereof, aliphatic liquid hydrocarbon resins, aliphatic solid hydrocarbon resins, liquid natural rubbers, hydrogenated polybutadienes, polytetramethylene ether glycols, copolymers of isooctyl acrylate and acrylic acid, and aliphatic zwitterionic amphiphilic acrylic polymers.

11. The abrasive article of claim 9, wherein the abrasive particles comprise shaped abrasive particles.

12. The abrasive article of claim 11, wherein the shaped abrasive particles comprise precisely-shaped abrasive particles.

13. The abrasive article of claim 11, wherein the shaped abrasive particles comprise precisely-shaped triangular platelets.

14. The abrasive article of claim 9, wherein the abrasive article is a coated abrasive article.

15. The abrasive article of claim 9, wherein the abrasive article is a nonwoven abrasive article.

16. The abrasive article of claim 9, wherein the substrate comprises a fiber scrim.

* * * * *